US008156619B2

(12) United States Patent
Bultschnieder et al.

(10) Patent No.: US 8,156,619 B2
(45) Date of Patent: Apr. 17, 2012

(54) HINGE AND METHOD OF MAKING SAME

(75) Inventors: André Bultschnieder, Rheda-Wledenbrück (DE); Uwe Sabrowski, Rheda-Wiedenbrück (DE)

(73) Assignee: Simonswerk GmbH, Rheda-Wiedenbrueck (DE)

( * ) Notice: Subject to any disclaimer, the term of this patent is extended or adjusted under 35 U.S.C. 154(b) by 873 days.

(21) Appl. No.: 12/107,917

(22) Filed: Apr. 23, 2008

(65) Prior Publication Data

US 2008/0263828 A1 Oct. 30, 2008

(30) Foreign Application Priority Data

Apr. 27, 2007 (DE) ..... 10 2007 019 939

(51) Int. Cl.
*B21D 53/40* (2006.01)

(52) U.S. Cl. ..... 29/11; 16/380

(58) Field of Classification Search ..... 29/11, 464, 29/468, 525, 525.01; 16/342, 344, 357, 358, 16/380, 381
See application file for complete search history.

(56) References Cited

U.S. PATENT DOCUMENTS

| | | | | | |
|---|---|---|---|---|---|
| 2,533,502 | A * | 12/1950 | Philips | 16/242 |
| 2,862,229 | A * | 12/1958 | Bacca | 16/342 |
| 3,013,297 | A * | 12/1961 | Ferry | 16/381 |
| 3,188,686 | A * | 6/1965 | Orcutt | 16/263 |
| 4,283,811 | A * | 8/1981 | George | 16/390 |
| 5,666,695 | A * | 9/1997 | Jegers et al. | 16/381 |
| 6,213,292 | B1 * | 4/2001 | Takahashi et al. | 198/853 |
| 6,317,928 | B1 * | 11/2001 | Guillemette | 16/353 |
| 7,108,127 | B2 * | 9/2006 | Krisl | 198/853 |
| 7,891,055 | B1 * | 2/2011 | Combs | 16/342 |

FOREIGN PATENT DOCUMENTS

| | | |
|---|---|---|
| DE | 819210 | 10/1951 |
| DE | 8701146 | 4/1988 |
| DE | 20115722 | 1/2002 |

* cited by examiner

*Primary Examiner* — David Bryant
*Assistant Examiner* — Ryan J Walters
(74) *Attorney, Agent, or Firm* — Andrew Wilford

(57) ABSTRACT

A method of making a hinge has the steps of forming a region of a piece of sheet metal with a groove and then bending the piece of sheet metal to form the region into an eye with the groove opening inwardly into the eye so that the piece of sheet metal with the eye forms a first leaf. A pivot pin with a radially outwardly projecting thickened region is fitted and pressed into the eye such that the radially thickened region radially elastically widens the eye. Once the thickened region reaches the groove, the eye springs back so that the pivot pin is then captured held in the eye.

6 Claims, 1 Drawing Sheet

HINGE AND METHOD OF MAKING SAME

FIELD OF THE INVENTION

The present invention relates to a hinge. More particularly this invention concerns a pin-type hinge and method of making it.

BACKGROUND OF THE INVENTION

A standard hinge has a first leaf and a second leaf that are connected at a pivot axis by a pin. At least the first leaf is made of sheet metal and has at least one not completely closed pivot eye. The eye is open at its ends so that the pivot pin must be secured against falling out.

A hinge of this type is known from German patent publication 201 15 722 in which the leaves each have three pivot eyes. The eyes of the two leaves of the two leaves are interleaved and coaxially aligned to receive a pivot pin and form a continuous pivot. In order that the pin does not fall out of the pivot that is open at its ends, one pivot eye is radially inwardly deformed to have a tapered area. The recess on the outside of the pivot eye produced by the deformation can be easily seen and has a significant adverse effect on the looks of the hinge. Furthermore, the considerable force needed for the plastic deformation that creates this shape can also have the result that the entire hinge warps.

German patent publication DE 819 210 describes a plate with two leaves connected to one another by a pintle. In order to fasten the pintle it is also rolled in place when the pivot eye is made, the eye either being formed by bending or having an indentation at the level of the eye. The looks of the plate are also adversely affected in this example by the deformation and also by an indentation.

Furthermore, it is known from practice that the pivot pin can be secured by a spring ring, a safety screw or a safety bolt. However, stocking additional structural parts and assembling them, as is suggested for example in DE 87 01 146, is disadvantageous on account of the increased costs. In this example the pin is designed as a complicated multipart bolt.

OBJECTS OF THE INVENTION

It is therefore an object of the present invention to provide an improved hinge and method of making same.

Another object is the provision of such an improved hinge and method of making same that overcomes the above-given disadvantages, in particular where the pivot pin is secured against falling out without further structural parts and without an optically adverse effect on the looks of the hinge.

SUMMARY OF THE INVENTION

A method of making a hinge has according to the invention the steps of forming a region of a piece of sheet metal with a groove and then bending the piece of sheet metal to form the region into an eye with the groove opening inwardly into the eye so that the piece of sheet metal with the eye forms a first leaf. A pivot pin with a radially outwardly projecting thickened region is fitted and pressed into the eye such that the radially thickened region radially elastically widens the eye. Once the thickened region reaches the groove, the eye springs back so that the pivot pin is then captured held in the eye.

The shape of the groove and the thickened region must be made generally complementary and the pivot pin preferably has a certain axial play when fitted therein. Tolerances can be compensated for in an especially simple manner by the play provided between the thickened region and the groove. The pressing-in of the pivot pin can take place without limitation by a machine with a press or by a manually driving it in.

According to a preferred embodiment of the invention the second leaf, which is made of sheet metal, has a pivot eye that is aligned between the pivot eye provided with the groove and a second outer pivot eye of the first leaf, the first leaf and the second leaf thus being inseparably connected by the pressing-in of the pivot pin. The slight but nevertheless present elasticity of the inherently stable structural parts is utilized here during the assembly by the action of force on the pivot pin. However it is also possible without limitation in the scope of the invention that the two leaves, as is also known from DE 202 15 722, each have several pivot eyes that form a continuous pivot in a coaxial arrangement. In order to ensure easy action of the hinge and to reduce wear, glide disks or slide sleeves can be arranged between the pivot eyes.

In the hinge according to the invention both leaves are preferably made of sheet metal without the further design of the hinge being limited. Thus, for example both leaves have bores for fastening to a door frame or a door wing. According to an alternative embodiment of the invention, one of the leaves is adjustability held in a leaf holder that can be set in a door wing or a door frame.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
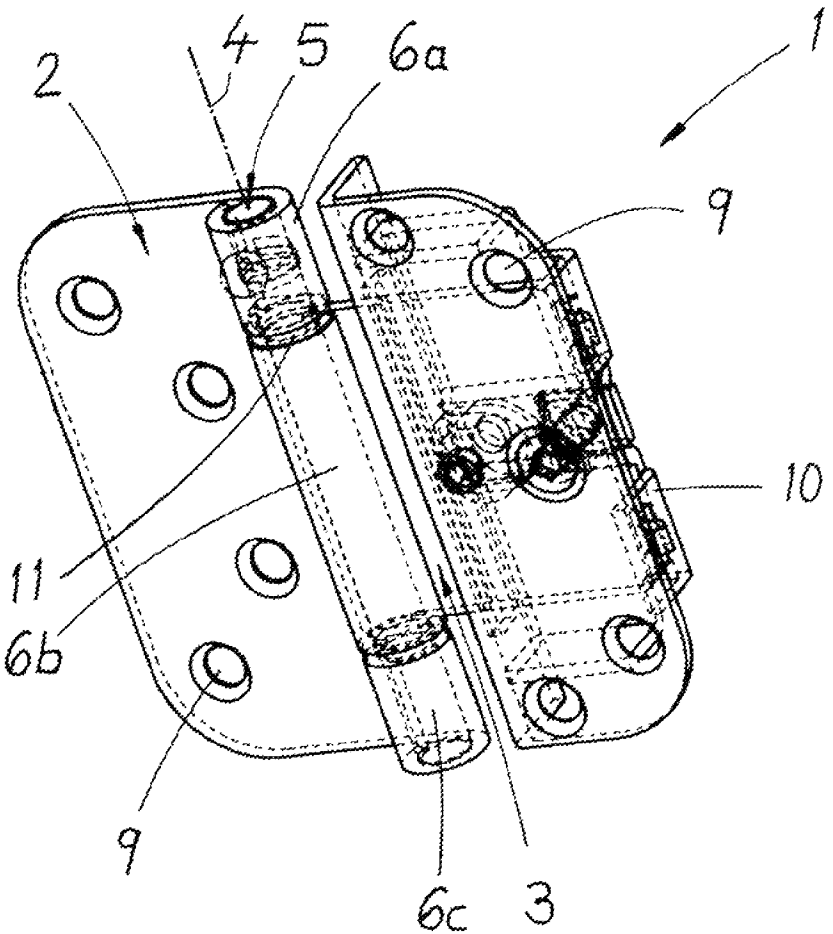
FIG. 1 is a perspective view of a hinge according to the invention.

As seen in FIG. 1 a hinge 1 has a first leaf 2 and a second leaf 3 that are both made of sheet metal and are connected at a pivot axis 4 by a pivot pin 5. An inner pivot eye 6*b* of the second leaf 3 fits between two outer pivot eyes 6*a* and 6*c* of the first leaf 2. The pivot eyes 6*a*, 6*b*, and 6*c* are formed from the sheet metal of the first and second leaves 2 and 3 by bending, with the pivot eyes 6*a*, 6*b*, 6*c* not being completely closed.

Figure 2:
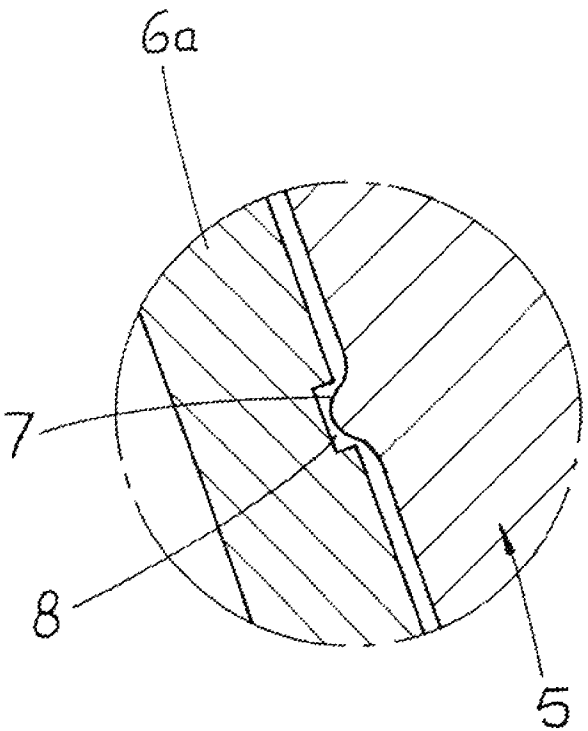
FIG. 2 is a large-scale sectional view of a detail of the hinge.

FIG. 2 shows that the pivot pin 5 has a radially outwardly projecting thickened region 7 produced by longitudinally compressing the pivot pin 5 so that a circumferential ridge is formed as the radially outwardly projecting thickened region 7. The radially outwardly projecting thickened region 7 engages into a respective inwardly open groove 8 of the respective pivot eye 6*a* of the first leaf 2 in such a manner that it is captured and cannot be lost. The first leaf 2 comprises the second outer pivot eye 6*c* in addition to the first outer pivot eye 6*a* with the inwardly open groove 8, and the inner pivot eye 6*b* of second leaf 3 is aligned on the axis 4 between the pivot outer eyes 6*a* and 6*c* of the first leaf 2. The groove 8 is produced during manufacture of the hinge 1 before the bending of the outer pivot eye 6*a*. Since the circumferential ridge 7 is somewhat smaller than the respective groove 8, the pivot pin 5 pressed into the pivot axis 4 has a slight axial play.

In the described illustrated embodiment the first leaf 2 is provided with bores 9 so it can be fastened directly to a door wing or to a door frame and the second leaf 3 is fastened via a leaf holder 10 in which the position of the second leaf 3 can be varied. Glide washers 11 are arranged between pivot eyes 6*a*, 6*b*, 6*c* for reducing wear and friction.

We claim:

1. A method of making a door hinge, the method comprising the steps of:

forming a region of a piece of sheet metal with a groove;

bending the piece of sheet metal to form the region into a first eye that is not completely closed with the groove opening inwardly into the first eye;

bending the piece of sheet metal to form a second eye spaced from and aligned with the first eye, the piece of sheet metal with the first and second eyes forming a first leaf;

providing a second leaf with a third eye fittable between the first and second eyes of the first leaf;

fitting the third eye of the second leaf between the first and second eyes of the first leaf with all the eyes aligned and coaxial and forming a pivot open at both ends;

longitudinally compressing a pivot pin so as to form it with a radially outwardly projecting thickened region forming a circumferential ridge;

fitting the pin to all of the eyes and pressing the ridge into the first eye such that the ridge radially elastically widens the first eye and fits into the groove thereof; and radially and elastically springing back the first eye when the ridge of the pivot pin reaches the inwardly open groove so that the ridge is captured in the groove and the pivot pin is then held in the first eye.

2. The hinge-making method defined in claim 1 wherein the second leaf is formed from sheet metal.

3. The hinge-making method defined in claim 1, further comprising the step of:

fitting slide bushings between the eyes before fitting the pivot pin to the eyes.

4. The hinge-making method defined in claim 1, wherein the groove and ridge are relatively so dimensioned that, when the ridge is captured in the groove, there is play between the ridge and the groove.

5. The hinge-making method defined in claim 4, wherein the play is axial of an axis of the pin.

6. The hinge-making method defined in claim 1 wherein the groove is formed to be, when the piece of sheet metal is formed into the first eye, radially inwardly open, circumferential, and radially outwardly closed relative to an axis of a pin-receiving passage formed by the first eye.

* * * * *